US005921124A

United States Patent [19]

Fink et al.

[11] Patent Number: 5,921,124

[45] **Date of Patent: *Jul. 13, 1999**

[54] DRAWING PROCESS CONTROL METHOD

[75] Inventors: Wolf-Dieter Fink, Preussisch Oldendorf; Gustav Matthies, Barntrup, both of Germany

[73] Assignee: Herborn & Breitenbach GmbH & Co. KG, Unna, Germany

[ * ] Notice: This patent is subject to a terminal disclaimer.

[21] Appl. No.: 08/855,218

[22] Filed: May 12, 1997

Related U.S. Application Data

[63] Continuation of application No. 08/418,615, Apr. 7, 1995, Pat. No. 5,628,219.

[30] Foreign Application Priority Data

Apr. 9, 1994 [DE] Germany ..... 44 12 268

[51] Int. Cl.[6] ..... B21C 1/12

[52] U.S. Cl. ..... 72/17.2; 72/21.4; 72/279; 72/288

[58] Field of Search ..... 72/17.2, 21.1, 72/21.4, 18.1, 18.4, 16.2, 16.6, 279, 288

[56] References Cited

U.S. PATENT DOCUMENTS

| | | | |
|---|---|---|---|
| 2,272,187 | 2/1942 | Dahlstrom | 72/279 |
| 3,798,939 | 3/1974 | Mertens | 72/279 |
| 4,662,203 | 5/1987 | Kanatani | 72/279 |

FOREIGN PATENT DOCUMENTS

| | | | |
|---|---|---|---|
| 12992 | 7/1980 | European Pat. Off. | 72/279 |
| 1072216 | 12/1959 | Germany . | |
| 2140580 | 8/1971 | Germany . | |
| 2749505 C2 | 5/1979 | Germany . | |
| 3009779 | 3/1980 | Germany . | |
| 4009732 A1 | 3/1990 | Germany . | |

*Primary Examiner*—Daniel C. Crane
*Attorney, Agent, or Firm*—Alix, Yale & Ristas, LLP

[57] ABSTRACT

A process for controlling a multiple stage drawing machine that implements a direct non-sliding drawing process provides for set-up and production to be automatic and for the variables necessary for process control, especially material speed and applied force, to be derived without establishing contact between the stock material and a sensing device.

7 Claims, 2 Drawing Sheets

DRAWING PROCESS CONTROL METHOD

CROSS-REFERENCE TO RELATED APPLICATION

This application is a continuing application of U.S. application Ser. No. 418,615 filed Apr. 7, 1995, now U.S. Pat. No. 5,628,219.

BACKGROUND OF THE INVENTION

1. Field of the Invention

The present invention relates to the exercise of control over a multi-stage drawing machine and, particularly, a machine which performs a direct, non-slip drawing of elongated stock material to form such material into a desired shape. More specifically, this invention is directed to the automatic set-up and subsequent control over the individual drives of a cascaded drawing system wherein stock material is serially pulled through a plurality of stationary dies. Accordingly, the general objects of the present invention are to provide novel and improved methods of such character.

2. Description of the Prior Art

Drawing systems for forming, from elongated stock typically fed from a supply reel, products having a desired cross-sectional size and shape are well known in the art. Such systems are commonly used to produce wire, endless strips and endless sections by a direct, non-slip, straight process without the intervention of cutting tools. The prior art drawing systems are provided with plural drives. These individual drives are typically located immediately downstream of an associated die and are independently adjustable to control the interrelated drawing process parameters of the speed of the stock material relative to the die and the force applied to pull the material through the die. These controllable process parameters will be adjusted, as a function of the forming process, to ensure that there will be no slippage of the stock material relative to the dies. As a practical matter, the process variables cannot be predetermined and set because the coaction of each individual die with the stock material will be different. These differences, i.e., the process dependencies, can result in the stock material being damaged or destroyed by, for example, being overstressed or being advanced to one of the cascaded dies too rapidly.

As a consequence of the operating difficulty briefly discussed above, conventional prior practice has been to have skilled operating personnel exercise manual control over the process variables. A drawing process wherein such manual control is exercised is described in German Patent 27 49 505. It has also been proposed to employ semi-automatic control employing relatively costly apparatus with control rollers such as, for example, described in German Patent 1 072 216. An alternative automatic control, wherein contact rollers are employed to sense the operating conditions intermediate the individual dies, is described in published German Patent Application 30 09 779. A further prior art approach to the exercise of control over a multiple die drawing machine, wherein the force on the individual die holders is measured, is described in published German Patent Application 2 140 580. Finally, in the proposed control process described in published German Application 40 09 732, sensors comprising rollers which are in contact with the stock material are used during the set-up and are retracted during continuous operation.

All of the above briefly described examples of prior art drawing machine control processes and apparatus share a common deficiency. Specifically, the productivity of the systems and the quality of the final product are highly dependent upon the experience and skill of the operating personnel. A further disadvantage of most of the prior art techniques which seek to obtain a degree of automation resides in the added cost and reduced system reliability incident to the use of contact rollers or other sensors which contact the stock material. The lack of reliability results from the inherent wear of the contact rollers. A further disadvantage incident to the use of contact rollers is that they necessarily reduce processing speed through tending to cause the stock material to be misaligned with the inlets of the drawing dies. Indeed, with some materials or sections, the added bending of the stock material resulting from the use of contact rollers cannot be tolerated because of the deleterious effect on the quality of the end product.

To summarize, there has been a long standing desire in the art to exercise automatic control over a multiple die drawing machine that implements a direct, non-slip drawing process. The desired automatic control would exercise supervision over the individual drives associated with each drawing die to ensure that the load imposed on the stock material and its speed would be adjusted to values commensurate with the instantaneous material properties as well as to values commensurate with conditions at the upstream and downstream dies. A control of the type long desired would determine the actual instantaneous parameters without the use of force measurement devices or other stock material contacting devices such as, for example, compensation rollers and contact rollers.

SUMMARY OF THE INVENTION

The present invention overcomes the above briefly described and other deficiencies and disadvantages of the prior art by means of a novel control method which enables both the set-up and subsequent operation of a multiple die drawing machine to be accomplished automatically. In accordance with the invention, the signals commensurate with the variable process parameters, and particularly stock material speed and applied force, are preferably derived directly from the drives of each of the means which draws the stock material through a die. In the practice of the present invention, the speeds of the stock material at the individual drawing dies are automatically and continually adjusted in accordance with forming ratios, such automatic and continual adjustment being accomplished even when there are changes in the forming devices or drawing dies.

Also in accordance with the present invention, and by way of distinction with the prior art, the final drive in the material flow direction is not operated as a guide or constant-speed drive. Rather, the last drive is associated with a speed controller which generates a signal commensurate with a desired value for the system load. This desired value is employed as a desired load value for the control and regulating devices associated with each drive. Accordingly, the desired load value is always automatically and continually adjusted to the process-related circumstances such as, for example, the amount of draft and the strength of the stock material. In one embodiment, the operation of the drawing unit is controlled by controlling the ratio of the desired stock material speed signal to the value of the drive speed command signal to achieve an equivalence between the value of the desired force signal and the value of the actual force signal.

BRIEF DESCRIPTION OF THE DRAWINGS

The present invention may be better understood, and its numerous objects and advantages will become apparent to those skilled in the art, by reference to the accompanying drawings in which.

DETAILED DESCRIPTION OF THE PREFERRED EMBODIMENT

Figure 1:
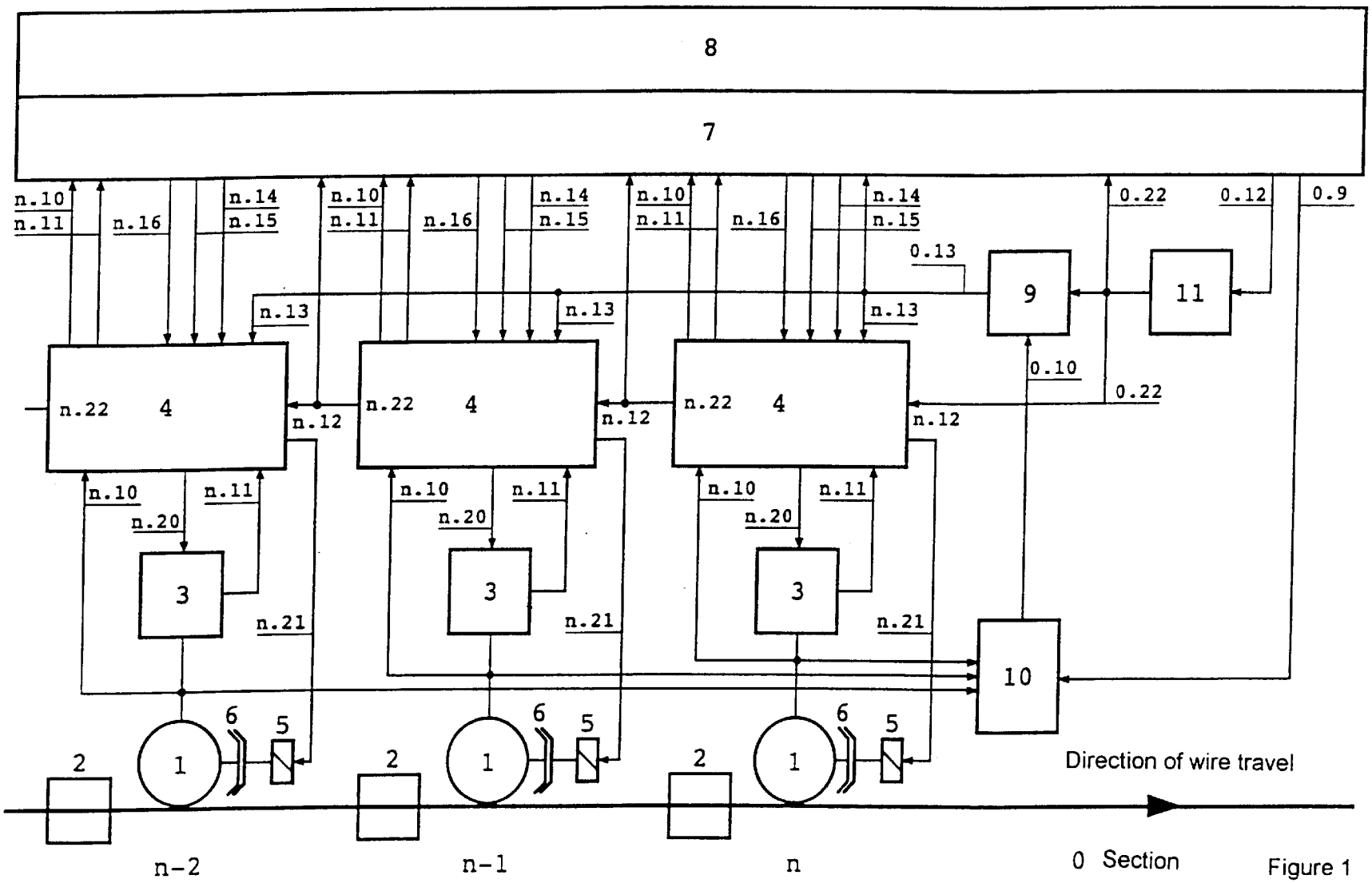
FIG. 1 is a schematic illustration of a control system for a cascaded multiple die drawing machine in accordance with the invention.

With reference to the drawings, a wire drawing system or machine having a plurality of stations or stages is shown schematically. For purposes of explanation, the drawing machine is shown as having three stations which are respectively indicated at n, n−1 and n−2. Each of these drawing stations includes a drawing unit 1, a drawing die 2, a holding brake or braking device 6 and a brake actuator control 5. The stock material being drawn to a final desired shape, a wire for example, is withdrawn from a supply reel, not shown, and serially pulled through the dies 2 by the associated drawing unit 1. The wire advances in the direction indicated by the bold arrow and may pass around the drawing units one or more times in order to enable the desired force to be applied to the stock material without slippage.

Each of the drawing units 1 is driven by an infinitely variable drive 3 which will include an electrical drive motor. These drive motors may be alternating or direct current devices which are controllable in the conventional manner to vary rotational speed and output power, i.e., developed torque. Each of the drives 3 has its own controller 4 for generating the motor control signals. The drives 3 and associated controllers 4 may, for convenience, be integrated into a single package.

In the practice of the disclosed embodiment of the present invention, the following signals are generated and utilized:

| Signal | Description |
|---|---|
| n.10 | Actual stock material speed |
| n.11 | Actual force applied to stock material (drawing station load) |
| n.12 | Desired drawing station stock material speed (input) |
| n.13 | Desired stock material applied force |
| n.14 | Ratio n.13/n.11 |
| n.15 | Counter-tension correction value |
| n.16 | Ratio n.12/n.20 (Qv value) |
| n.20 | Drive speed command signal |
| n.21 | Synchronous control (braking command) |
| n.22 | Desired stock material speed (adjusted output) |
| 0.10 | Actual instantaneous stock material speed used for system control |
| 0.12 | Line speed |
| 0.13 | Desired system load (equals n.13) |
| 0.22 | Desired system speed (equals n.12 for station n |
| $Qv = 1 - D_1^{2/D_2^2}$ where: $D_1$ = wire diameter before drafting; $D_2$ = wire diameter after drafting | Amount of draft deformation (reduction in cross-section) |

The actual stock material feed velocity or speed signals n.10 and the actual load signals n.11 are derived from parameters which are measurable at each drawing unit 1 either by monitoring the operation of the drive 3 or the drum or the like which pulls the stock material through the die. Thus, the n.10 speed signals may, for example, be the rotational speed of the motor of drive 3 or the rotational speed of the drum of the drawing unit 1. These signals may either be direct current or alternating current depending on the type of drive. Similarly, the load signals n.11 may be in the form of measurements of developed torque or the power being consumed by the drive 3. The important point, of course, is that the same variable be measured at each drawing station and that all of the variables be converted, as necessary, into a system of values suitable for processing. For example, the controllers 4 and 9 may include analog to digital convertors for pre-processing the sensed operating parameters and digital to analog convertors for the generated command signals.

The disclosed system further includes a speed controller 9 which generates, in response to 0.10 and 0.22 signals, the 0.13 desired system load value. This desired system load value is employed as the desired load value n.13 signal which is simultaneously delivered to each of the controllers 4.

A wire drawing process monitor 7 is designed to communicate continuously with all components of the line (refer to FIG. 1), and log or collect process data which are analyzed in the light of one or several process models so as to detect process variations which would adversely affect the back-pull forces, e.g. drafting of the wire in each wire drawing die, or load changes induced by variations in material properties and, hence, friction alterations in the wire drawing die.

A line control system 8 controls the operating conditions which are set by the wire drawing machine operator. The control is preferably primarily accomplished by a PLC (programmable logic controller). The line control system 8 may consist of a central PLC such as a Siemens S 5 controller, or a decentralized system that is interconnected through a bus. The wire drawing machine control system 4 and the infinitely variable drive units 3 may also be tied into the control system. In this case, the CPU (central processing unit) for the PLC may be a slot PLC (also referred to as slot CPU) which, being a printed circuit board, is plugged into a personal computer (PC) or an industrial PC (IPC).

The hardware to be used for the wire drawing process monitor 7 may be a commercial PC which is connected to, and communicates with, the PLC through one of its interfaces. Moreover, this computer may be used for process visualization on a display screen and for production data logging. This may be the PC in which the slot PLC is fitted. In this case, the line control system 8 is linked to the wire drawing process monitor 7 directly in the PC through the PC system bus. It is also understood that any of the line control system 8 or wire drawing process monitor 7 may comprise an industrial PC (IPC).

The product speed controller 9 may be a PI controller (proportional and integral controller) or a PID controller (proportional, integral and derivative controller). The system desired speed value, i.e., the 0.22 signal supplied as an input to signal generator 9, is provided by an integrator 11. The reference integrator 11 is a slope limiter (ramp-up integrator or ramp-up synchro) device that receives its input signal as line speed signal 0.12 from the line control system 8 or from the wire drawing process monitor 7 (as applicable).

A reference integrator serves to control the output signal along a defined ramp until it has reached the value of the input signal. This system desired speed value 0.22 is also used as the speed reference signal n.12 delivered to the controller 4 of drawing station n. The desired speed value signal n.12 is serially assessed, and modified if necessary, while being passed from controller to controller. Thus the 0.22 signal functions as the desired speed or rpm reference value of the cascade, i.e., the system speed value, and each of the cascaded controllers 4 outputs an n.22 desired speed value which is employed as the n.12 desired speed input for the next upstream drawing station which is operative. In the controller 4 associated with the last or most downstream operative drawing station, station n in the example being described, the 0.22/n.12 signal is compared with a n.10 signal provided by the drawing unit 1/drive 3 of that station. The load controller 4 is followed up through tracking of values or signals such as scaling signal n.14, the back pull corrective value n.15 and the Qv value n.16 such that process-induced disturbances are detected in good time and eliminated by means of a cascade control.

The product speed reference input signal n.12 of the wire drawing machine control system 4 is activated by the output of the setpoint integrator 11. The output of the setpoint integrator 11 also functions as the product speed reference input signal 0.22 for the product speed controller 9 which, through the actual product speed 0.10, determines the load-induced product speed error on the drive or line characteristic V=f(M) [where M is the load torque] and, by integrating this product speed error, forms the nominal load reference 0.13. This output signal 0.13 of the product speed controller 9 is applied in parallel to the load reference n.13 inputs of the wire drawing machine control system 4 as the nominal load reference n.13 (refer to FIG. 1). The mode of function of the product speed controller 9 is identical to that of a speed controller in a D.C. drive with current control feature.

As the nominal speed reference n.13 is preset by the product speed controller 9, variations occurring in the wire strength are prevented from adversely affecting the product speed ratios through the drive characteristic n=f(M) [where M is the load torque], and the load value of the line is allowed to assume any level as a function of the current (instantaneous) wire strength.

The actual load value n.11 is measured by the infinitely variable drive unit 3 and transmitted to the wire drawing machine control system 4 (refer to FIG. 1). This actual-load value n.11 is passed on by the wire drawing machine control system 4 to the line control system 8 or to the wire drawing process monitor 7.

Figure 2:
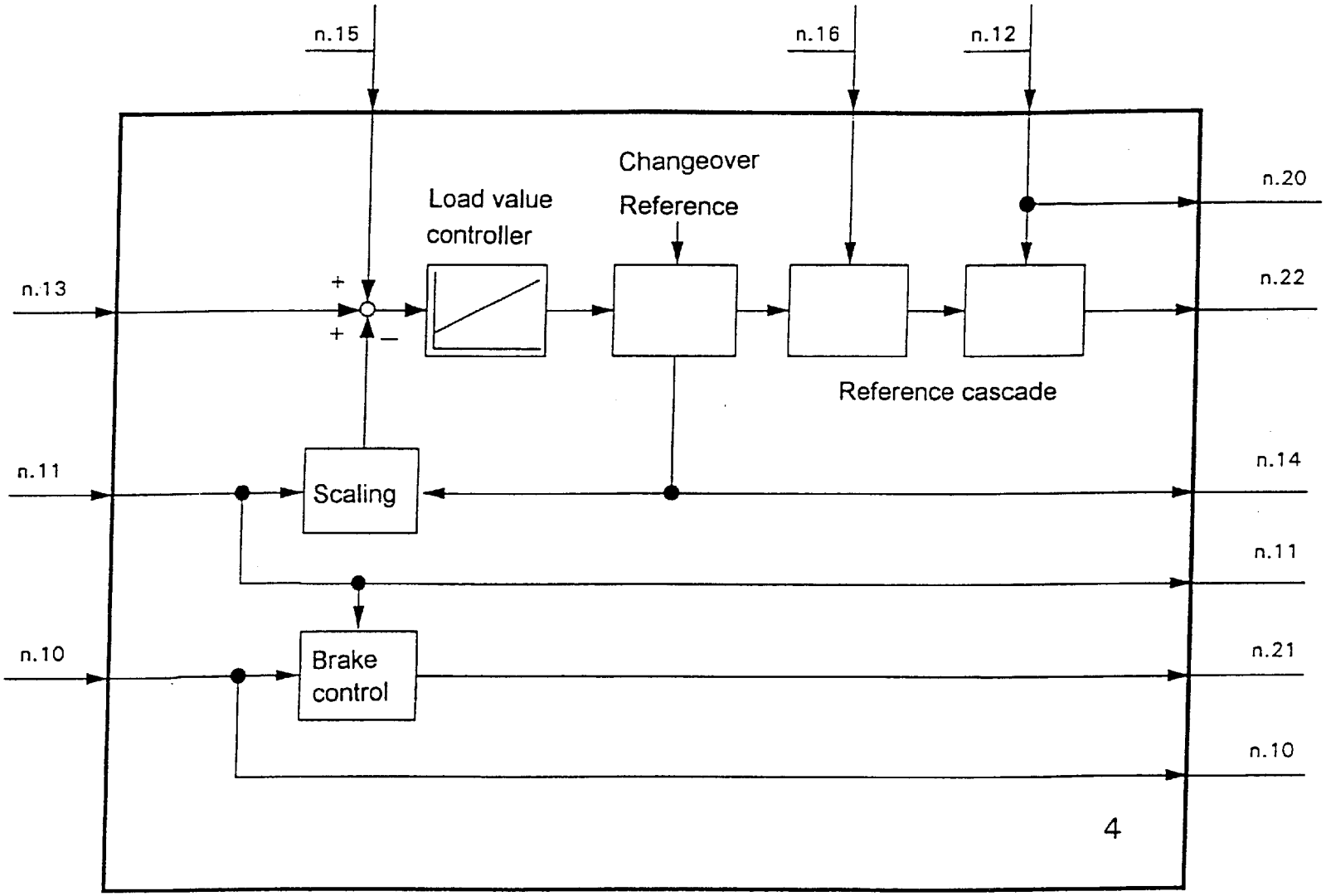
FIG. 2 is a schematic illustration of the signal flow for a controller of the control system of FIG. 1.

The actual load value or the load reference (as applicable) is automatically scaled in the wire drawing machine control system 4 while the wire is being threaded into the drawing die (in the setting mode). During this threading (setting) operation, each drive is loaded only with the force required for drafting the wire. To this end, the product speed controller 9 is disabled in that the line control system 8 or the wire drawing process monitor 7 (i) sets the nominal load value reference n.13 to the rated load (100%), and (ii) switches the output of the load controller from the reference cascade to the scaling signal n.14 (refer to FIG. 2—changeover/reference).

Thus, during the threading operation, the load controller performs scaling of the actual load value to the load value reference as a function of the current condition of the wire drawing process, with the scaling value n.14 applied to the wire drawing machine control system 4 as an output signal. The scaling value n.14 can be stored in the machine control system 4 as well as in the line control system 8, or in the wire drawing process monitor 7 (as applicable).

This scaling is adopted to achieve a proportional load sharing of the individual infinitely variable drives 3 (which reflects the current condition of the wire drawing process) in respect of the overall load value of the line. Thus, when the nominal load value reference n.13 is changed by the product speed controller 9, the ratio of the drives 3 relative to the overall load of the line is maintained, or distortion because of the drive characteristics n=f(M) [where M=load torque] is ruled out by the load controller.

The load controller in the wire drawing machine control system 4 (refer to FIG. 2) is designed to avoid load ratio offsets among the drives or looping as may be induced by slack wire, in that the load controller operating as a PI controller continually compares the nominal load value reference n.13 and the counter-tension correction value n.15 to the scaled actual-load value signal n.11 to work into the reference cascade such that the resultant reference ratios reflect those prevailing in the wire speed as a function of the wire drawing process.

The drives 3 are 'rigidly' linked through drawing blocks 1 and the wire, unless there is a slack wire. This is accomplished in that the load controller, through its output, adjusts the Qv value n.16 (product speed ratio signal of the reference cascade) (refer to FIG. 2) such that, in relation to the current condition in the wire drawing process, there are no errors resulting between the speed reference n.20 (output signal to the associated infinitely variable drive unit 3) and the product speed reference n.22 (output signal to the downstream wire drawing machine control system 4 (n−1)) and, hence, the references are adjusted as a function of the actual wire speeds.

It is understood that the reference cascade may also be arranged such that the product speed reference input signal n.12 is changed relative to the speed reference output signal n.20 and the product speed reference output signal n.22.

The input signals, such as the counter-tension correction value n.15 for the load controller and the Qv value n.16 being the product speed ratio signal to bias the reference cascade in the wire drawing machine control system 4, are preset by the line control system 8 or the wire drawing process monitor 7 (as applicable) and adjusted during the wire drawing process by control system 8 or process monitor 7 as necessary.

Arranged integral with the wire drawing machine control system 4 is a brake control feature to ensure smooth (jerk-free) starting and stopping of the wire drawing line. The brake control is designed to sequence through the brake control output signal n.21 the brake actuator and control unit 5 such that, in starting, the holding brake 6 is released as a function of the actual-load value signal n.11 or the scaled actual-load value and, in stopping, the holding brake 6 is applied as a function of the actual-speed signal n.10 at n~0 before the actual-load signal breaks down. Stated differently, after the zero speed condition has been detected and the holding brake 6 activated, the operating status of the infinitely variable drive unit is maintained while allowing for the time to control the brake such that the drive keeps the wire tight until the holding brake is applied.

This brake control feature can also be accomplished by the line control system 8 or the wire drawing process monitor 7 (as applicable).

The actual speed n.10 'measured' by the infinitely variable drive unit 3 is passed on to the line control system 8 or the wire drawing process monitor 7 (as applicable) by the wire drawing machine control system 4.

The control system also includes an automatic selection switch 10 to which the actual speed n.10 signals from each of the drawing stations are delivered. When the system is in partial operation, the switch 10 will pass, to signal generator 9 as the actual speed value 0.10, the speed signal generated at the last, i.e., most downstream, of the drawing stations which is actually working the stock material. In the case of a drawing station which is not in operation, the desired speed value input signal n.12 will be fed back without modification, i.e., the n.22 output signal value from the controller of an inoperative drawing station will be equal to the n.12 desired speed signal applied at the input to the controller of that station.

Presetting the product speed reference 0.22 in parallel to the input signal to the product speed controller 9, which is fed into the wire drawing machine control system 4 as product speed reference input signal n.12, merely serves to bias in this application.

The controllers 4 operate upon the actual and desired speed and load signals in accordance with process-dependent values and parameters. For example, there will be a predetermined ratio n.16 of the desired input signal value n.12 to the desired output signal value n.22 for each drive 3, these ratios being dependent on the Qv value, as well as the proportional gain, restoring and rate times for the controller 4. Presetting of the controllers with these process-dependent values and parameters is accomplished by means of an overall system controller 8, and the values and parameters may be varied during drawing by the system controller 8.

The system controller 8 is interfaced to the individual station controllers 4 by means of an "observer" 7. This interface device 7 constantly measures the process variables n.10 and n.11 and their desired or computed values n.20, n.12 and n.13 and continually calculates the corresponding process and system conditions. The device 7, in response to the measured process variables and values, and additional input information including changes in material strength, degree of forming (Qv actual value) and the material storage on the drawing disks, calculates the ratios or correction factors necessary to make the desired load value signal n.13 consistent with the actual load signal n.11. The device 7 also generates the counter-drawing correction value n.15 as well as corresponding corrections in the respective controllers 4 in order to follow up and control wear-related process parameters.

In one mode of operation, the operation of each drawing unit is independently controlled as a function of the actual speed signal n.10 and desired speed signal n.12 and the actual force signal n.11 and desired force signal n.13 by controlling the ratio of the value of the desired stock material speed signal n.22 to the value of the drive speed command signal n.20 to thereby achieve an equivalence between the value of the desired force signal n.13 and the value of the actual force signal n.11.

The controllers 4 cooperate with the system controller 8 to achieve synchronous control, via command signal n.21, of the actuators 5 for the brakes 6. This synchronous control adjusts the brakes for the load conditions, in accordance with a drawing program, when the system is started in dependency on the actual load n.11. The brakes 6 are also synchronously controlled during stopping of the system in dependency on the actual value of the command signals n.20.

While a preferred embodiment has been shown as described, various modifications and substitutions may be made thereto without departing from the spirit and scope of the invention. Accordingly, it is to be understood that the present invention has been described by way of illustration and not limitation.

What is claimed is:

1. A method for controlling a direct, non-slip wire drawing process, the process including subjecting elongated stock material to the action of a plurality n of serially arranged stationary drawing dies, each die being associated with a separate drawing means having a drive, said control method comprising the steps of:

determining the linear speed of the stock material in the vicinity of each die and generating a rotational speed signal (n.10) commensurate therewith, said speed signal being derived from an operating parameter of an associated means for drawing the stock material through the die;

determining the force applied to the stock material to pull it through each die and generating a force signal (n.11) commensurate therewith, said force signal being a function of an operating parameter of the associated means for drawing the stock material through each die;

generating a desired speed signal (n.12) commensurate with the desired stock material linear speed upon exit from the last die;

generating a desired force signal (n.13) commensurate with the desired force to be applied to the stock material;

generating a drive speed command signal (n.20) for the drive of each drawing means;

generating a desired stock material speed signal (n.22); and independently controlling the operation of the drawing means as a function of the actual speed signal (n.10) and desired speed signal (n.12) and actual force signal (n.11) and desired force signal (n.13) by controlling the ratio of the value of the desired stock material speed signal (n.22) to the value of the drive speed command signal (n.20) to achieve an equivalence between the value of the desired force signal (n.13) and the value of the actual force signal (n.11).

2. The method of claim 1 wherein each drawing means has a controller and further comprising generating a desired system force signal (0.13) value, which is simultaneously the desired force signal (n.13) value for all the drawing means, from the desired output value of a speed controller, which obtains its desired system speed value (0.22) from a value integrator (11), which serves at the same time as a desired speed signal (n.12) value for the nth controller (4) as a desired speed value signal in cascade, wherein the actual system speed value (0.10) for the speed controller (9) is the actual speed signal (n.10) value of the nth drive (3).

3. The method of claim 2 wherein when the system is partially operating, the actual system speed signal (0.10) for the speed controller turns on the actual stock material speed signal (n.10) for the actual speed value via a corresponding selection switch on the last drawing means that works in the direction of the material flow, and the corresponding desired drawing station input speed signal (n.12) on the drawing means not in operation is forwarded unaffected to the desired stock speed adjusted output signal (n.22).

4. The method of claim 1 wherein each drawing means has a controller, and the desired drawing station input speed signal (n.12) for the drawing means is forwarded unchanged as the drive speed command signal (n.20) to the control of the associated drive (3).

5. The method of claim 1 further comprising presetting process-dependent values and parameters which affect each drawing means selected from the group consisting of the ratio (n.16), which is dependent on the amount of draft (Qv value), of the desired speed signal (n.12) value to the desired drive speed command signal (n.20) value for the drawing means, the proportional gain, the restoring and rate times for the drawing means.

6. The method of claim 1 further comprising providing backpull correction values and constantly monitoring the drawing process while constantly measuring process variables selected from the group consisting of the actual speed (n.10), the actual force (n.11), the desired stock material force (n.13) and the drive speed command signal (n.20) and, depending on the process and system conditions, continually calculating changes in material strength, and amount of draft (Qv actual value), and according to the drawing process, scaling the ratios (n.14) of the desired value of the force signal (n.13) to the value of the actual force signal (n.11) and the backpull correction values (n.15).

7. The method of claim 1 wherein each drawing means has a controller, a brake control and a braking device and further comprising generating a synchronous control signal (n.21) from the controllers to the brake controls (5) for activating the braking devices (6) on each of the drawing means.

* * * * *